US010968092B2

(12) United States Patent
Green et al.

(10) Patent No.: US 10,968,092 B2
(45) Date of Patent: Apr. 6, 2021

(54) DISPENSING APPARATUS WITH VALVE

(71) Applicants: Scott David Green, Irondale, AL (US); Joseph Michael Wyatt, Pinson, AL (US)

(72) Inventors: Scott David Green, Irondale, AL (US); Joseph Michael Wyatt, Pinson, AL (US)

( * ) Notice: Subject to any disclaimer, the term of this patent is extended or adjusted under 35 U.S.C. 154(b) by 0 days.

(21) Appl. No.: 16/364,411

(22) Filed: Mar. 26, 2019

(65) Prior Publication Data

US 2020/0307981 A1 Oct. 1, 2020

(51) Int. Cl.
*B67C 11/04* (2006.01)

(52) U.S. Cl.
CPC ..... *B67C 11/04* (2013.01)

(58) Field of Classification Search
CPC ..... B67C 11/04; B65D 83/06; G07F 11/44; A47G 19/32; A47F 1/03
USPC ..... 141/346, 363, 345
See application file for complete search history.

(56) References Cited

U.S. PATENT DOCUMENTS 1,455,970 A * 5/1923 Resek ..... A47K 5/10 222/153.03
2,128,488 A * 8/1938 Koerner ..... A47K 5/10 141/360
2,410,410 A * 11/1946 Garubo ..... B65D 47/286 222/184
2,480,733 A * 8/1949 Hermani ..... B65D 47/28 222/560
2,626,089 A * 1/1953 Osfar ..... B65D 47/286 222/511
2,694,515 A * 11/1954 Green ..... B65B 1/28 141/300
3,193,159 A * 7/1965 Swindler ..... G01F 11/18 222/336

(Continued)

*Primary Examiner* — Timothy L Maust
*Assistant Examiner* — James R Hakomaki

(57) ABSTRACT

A dispensing apparatus for dispensing a material, comprising: a removable container for holding the material; a receptacle for receiving the material, the receptacle comprising a top opening and a flange; a funnel for receiving the material from the removable container and guiding the material to the receptacle, the funnel comprising a valve holder at a lower end of the funnel and a lower opening aligned with the top opening of the receptacle; a valve member slidably coupled to the valve holder, the valve member comprising a valve aperture; a valve lever connected to the valve member, wherein when activated, the valve lever is configured to move the valve member to cause the valve aperture to align with the lower opening of the funnel, allowing the material to flow down from the funnel to the receptacle until the receptacle is filled to the top opening; a lever assembly coupled to the valve lever, wherein the lever assembly is configured to be activated by an operator inserting the flange of the receptacle into the lever assembly, and when activated, the lever assembly is configured to activate the valve lever; and a gap separating the valve member and the top opening of the receptacle, the gap having a gap width greater than zero and less than a predetermine value, wherein when the valve lever is activated and the material flows down and fills the receptacle to the top opening, the material further fills the gap, causing the material to stop flowing down.

19 Claims, 16 Drawing Sheets

(56) References Cited

U.S. PATENT DOCUMENTS 4,243,158 A * 1/1981 Negosta ..... A47K 5/10 222/184
4,856,681 A * 8/1989 Murray ..... A47F 1/035 222/158
5,979,717 A * 11/1999 Dalton ..... A47F 1/03 222/526
5,996,857 A * 12/1999 Markos ..... B65D 47/268 222/531
6,145,705 A * 11/2000 Wallace ..... A47G 19/34 222/160
6,182,864 B1 * 2/2001 Elmore ..... A47F 1/035 222/129
6,883,686 B2 * 4/2005 Langlois ..... A47F 1/03 222/152
6,997,352 B2 * 2/2006 Sallows ..... B67D 7/0294 141/114
7,178,697 B2 * 2/2007 Brundick ..... A47F 1/03 222/181.1
7,588,062 B1 * 9/2009 Green ..... G07F 11/44 141/351
8,042,581 B2 * 10/2011 Green ..... B65B 39/002 141/360
8,413,852 B2 * 4/2013 Ophardt ..... G01F 11/025 222/181.3
8,798,199 B2 * 8/2014 Lozhkin ..... H03F 1/0294 375/260
8,851,334 B2 * 10/2014 Green ..... B65D 83/06 222/230
8,887,964 B2 * 11/2014 Jokitalo ..... A47K 5/1208 222/207
8,919,395 B2 * 12/2014 Green ..... B65B 39/004 141/372
9,585,504 B2 * 3/2017 Kestner ..... G01F 11/18
2005/0269366 A1 * 12/2005 Brundick ..... A47F 1/03 222/185.1
2012/0199244 A1 * 8/2012 James ..... G07F 9/105 141/331

* cited by examiner

DISPENSING APPARATUS WITH VALVE

REFERENCE TO RELATED APPLICATIONS

This is a first-filed invention.

BACKGROUND OF THE INVENTION

The present disclosure relates to dispensers, and more particularly, to a dispensing apparatus and method for dispensing flowable solid materials.

Devices are known for filling receptacles with granular, particulate, and/or powdered materials that are transported from a storage container into a receptacle. Dispensing mechanisms for these devices range from open containers with scoops to coin operated machines. Granular matter, such as sand, can be provided in various colors and can be dispensed from storage containers to produce a decorative art form in a transparent receptacle. Likewise, granular food products, such as powdered candy, can also be dispensed to produce a decorative art form in a receptacle with the added attraction of being edible. However, granular or powdered food products need special care to avoid contamination.

Thus, there is a need for granular food dispensing system that allows for the controlled dispense of the materials and will also avoid contamination between the dispensing mechanism and the receptacles that receive it. In addition, it is desirable have a mechanism in a dispensing system to automatically shut off the flow of the material being dispensed when the receptacle is filled to a maximum level, so spills can be avoided.

SUMMARY OF THE INVENTION

The present disclosure provides a dispenser apparatus with a valve. The dispensing apparatus includes: a removable container for holding the material; a receptacle for receiving the material, the receptacle comprising a top opening and a flange; a funnel for receiving the material from the removable container and guiding the material to the receptacle, the funnel comprising a valve holder at a lower end of the funnel and a lower opening aligned with the top opening of the receptacle; a valve member slidably coupled to the valve holder, the valve member comprising a valve aperture; a valve lever connected to the valve member, wherein when activated, the valve lever is configured to move the valve member to cause the valve aperture to align with the lower opening of the funnel, allowing the material to flow down from the funnel to the receptacle until the receptacle is filled to the top opening; a lever assembly coupled to the valve lever, wherein the lever assembly is configured to be activated by an operator inserting the flange of the receptacle into the lever assembly, and when activated, the lever assembly is configured to activate the valve lever; and a gap separating the valve member and the top opening of the receptacle, the gap having a gap width greater than zero and less than a predetermine value, wherein when the valve lever is activated and the material flows down and fills the receptacle to the top opening, the material further fills the gap, causing the material to stop flowing down.

In certain embodiments, the dispensing apparatus further includes a back frame. The back frame includes a pair of holes and a pair of stop features.

In certain embodiments, the lever assembly includes: a receptacle holder, the receptacle holder including a pair of actuating slots to receive the flange of the receptacle, a pair of mount lugs pivotally mount the receptacle holder to the back frame through the pair of holes of the back frame, and a pair of stop lugs protruding from the receptacle holder; and a main frame spring having a first end connected to the receptacle holder and a second end connected to the back frame, the springs tilting the receptacle holder away from the back frame until the stop lugs of the receptacle holder contact the stop features of the back frame.

In certain embodiments, the lever assembly further includes a pair of lever flanges, each lever flange comprising a flat lever flange member, and a mount hole in the flat lever flange member allowing one of the mount lugs of the receptacle holder loosely fitting into the mount hole.

In certain embodiments, the back frame further comprises a pair of limiting slots, and each lever flange further comprises a stop member protruding from the flat flange member, wherein the stop members fit through the limiting slots and the limit slots limit a pivoting range of the lever flanges.

In certain embodiments, the lever assembly further includes: a pair of control arms, each control arm having a first end, a second end, and a control arm flange between the first end and the second end; and a linking spring connecting the first ends of the pair of control arms. The second ends of the control arms are pivotally attached within the actuating slots of the receptacle holder; and when the receptacle is pushed into the receptacle holder with the flange of the receptacle received into the actuating slots of the receptacle holder, the pair of the control arms are pivoted outward, and the flanges of the control arms extend beyond the actuating slots and engage the lever flanges.

In certain embodiments, the lever assembly further comprises a connecting rod connecting the pair of lever flanges.

In certain embodiments, the valve lever includes: a lever pivotal rod, a pair of lever arms extending from the lever pivotal rod, an actuator pin extending from a middle point of the lever pivotal rod, the actuator pin being fixedly attached to the valve member, and a valve lever spring connecting the actuator pin and a back end of the valve holder.

In certain embodiments, the dispensing apparatus further includes an agitator. The agitator includes an agitator axle and an agitator arm extending from a middle point of the agitator axle.

In certain embodiments, the dispensing apparatus further includes a removable cover to limit ambient powder material during dispensing. The above invention aspects will be made clear in the drawings and detailed description of the invention.

BRIEF DESCRIPTION OF THE DRAWINGS

An embodiment of the present disclosure will now be described, by way of example only, with reference to the following drawings, in which:

FIG. 2C is another section-projection view of the dispensing apparatus of FIG. 1A in the inactivated operation mode;

Figure 1A:
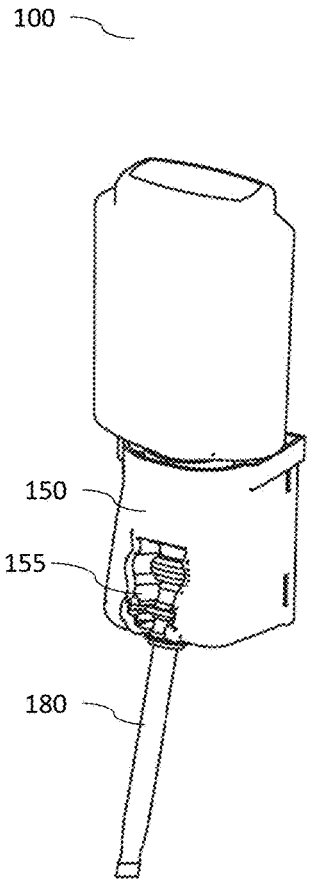
FIG. 1A is a perspective view of a dispensing apparatus in an inactivated operation mode according to an embodiment of the present disclosure.
Figure 1B:
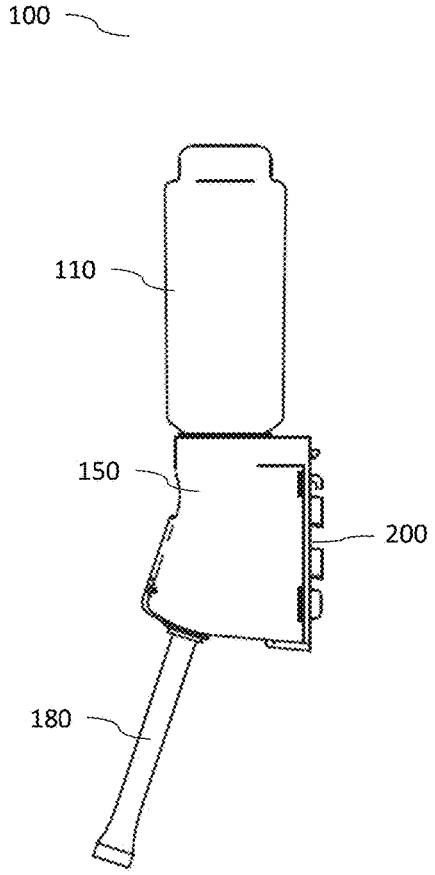
FIG. 1B is a side view of the dispensing apparatus of FIG. 1A in the inactivated operation mode.
Figure 1C:
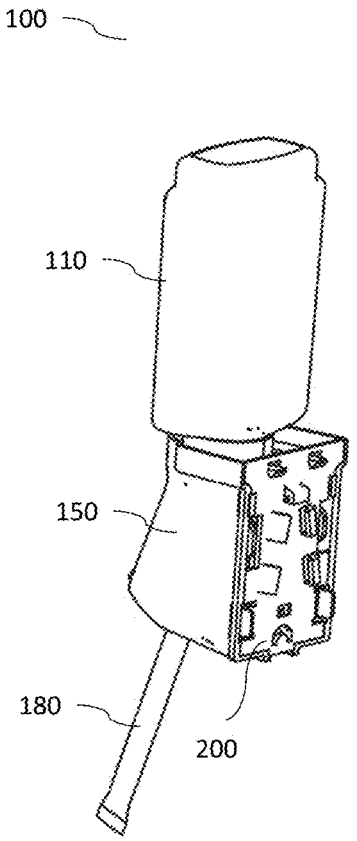
FIG. 1C is another perspective view of the dispensing apparatus of FIG. 1A in the inactivated operation mode.
Figure 2A:
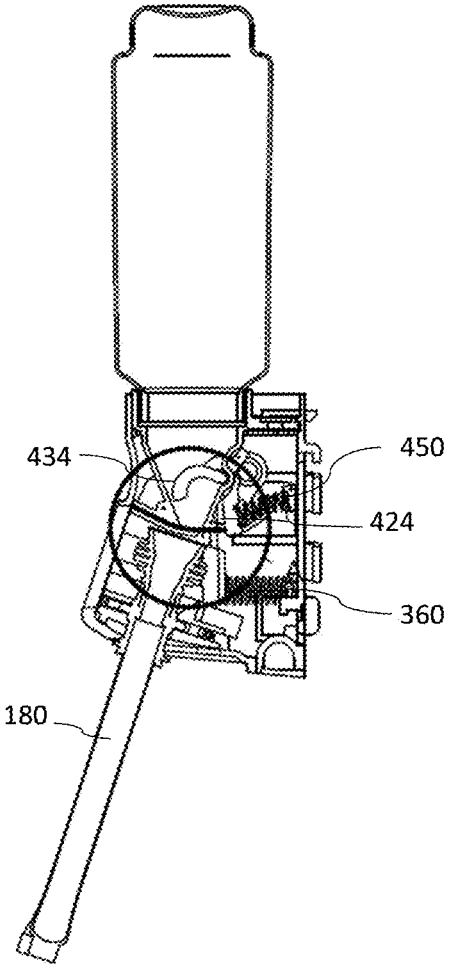
FIG. 2A is a section view of the dispensing apparatus of FIG. 1A in the inactivated operation mode.
Figure 2B:
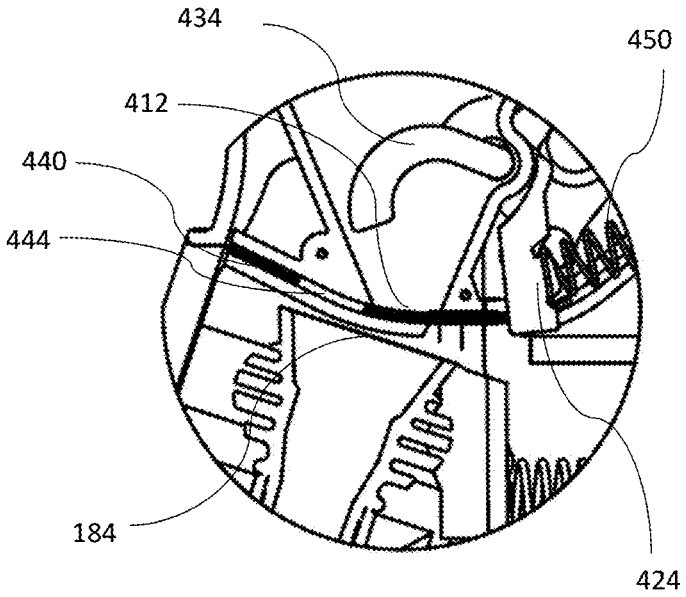
FIG. 2B is a detailed section view showing the valve mechanism of the dispensing apparatus of FIG. 2A in the inactivated operation mode.
Figure 3A:
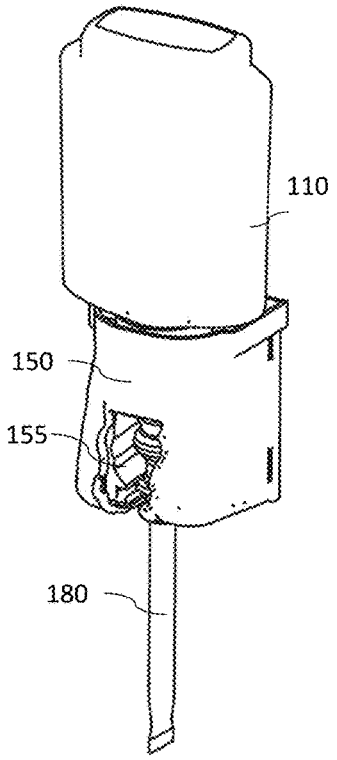
FIG. 3A is a perspective view of the dispensing apparatus of FIG. 1A in an activated operation mode.
Figure 3B:
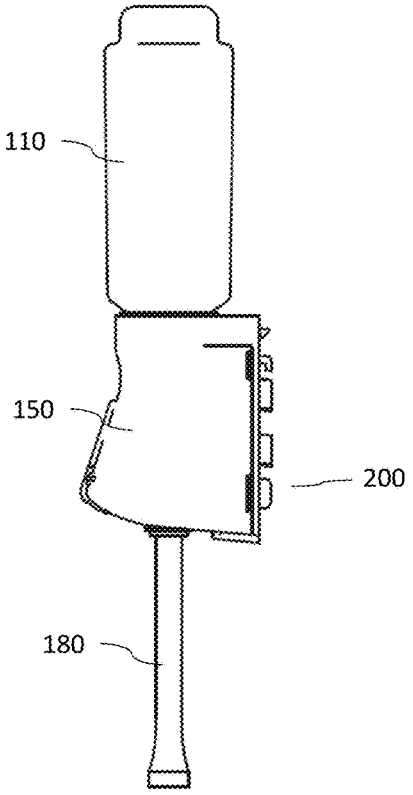
FIG. 3B is a side view of the dispensing apparatus of FIG. 3A in the activated operation mode.
Figure 3C:
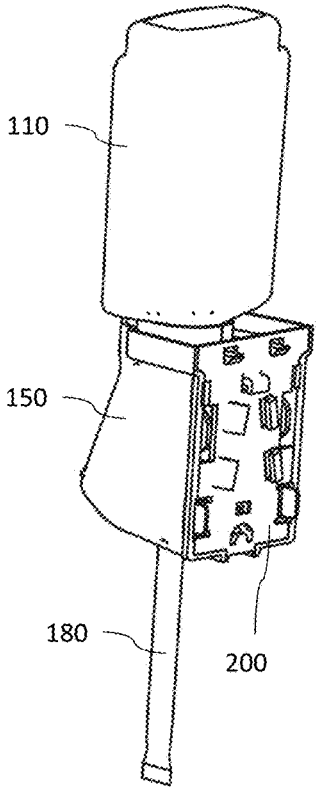
FIG. 3C is another perspective view of the dispensing apparatus of FIG. 3A in the activated operation mode.
Figure 4A:
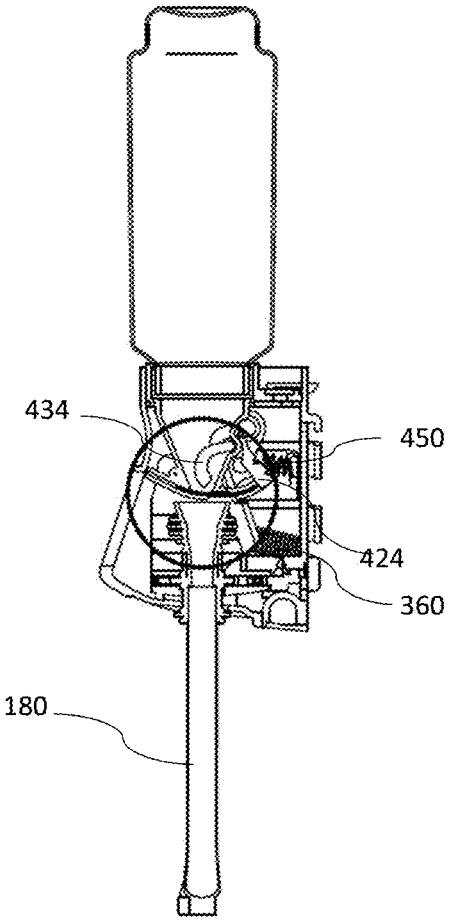
FIG. 4A is a section view of the dispensing apparatus of FIG. 3A in the activated operation mode.
Figure 4B:
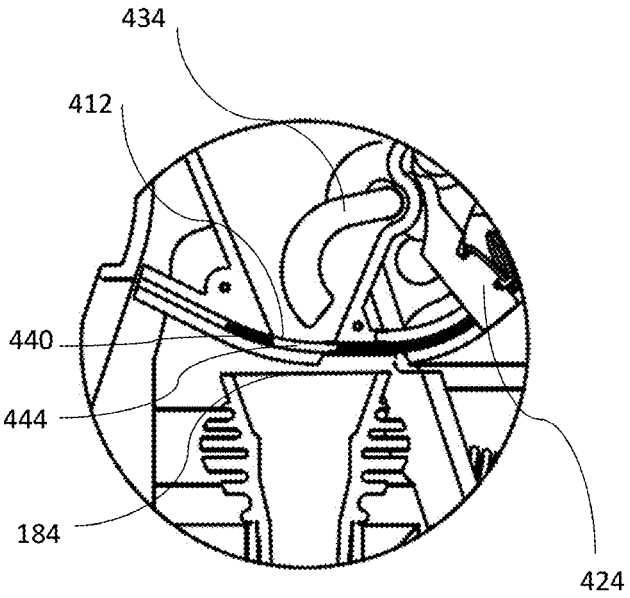
FIG. 4B is a detailed section view showing the valve mechanism of the dispensing apparatus of FIG. 4A in the activated operation mode.
Figure 5A:
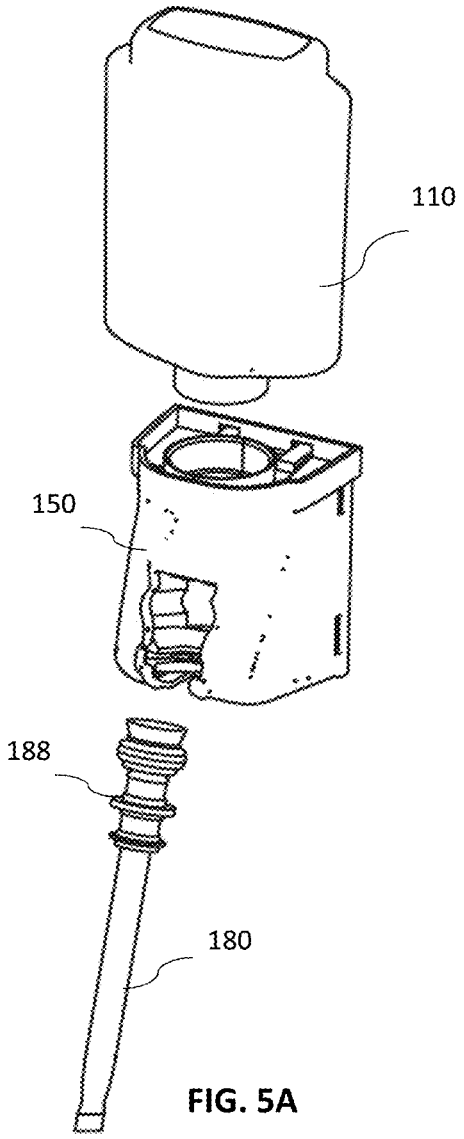
FIG. 5A is a perspective exploded view of the dispensing apparatus of FIG. 1A in the inactivated operation mode.
Figure 5B:
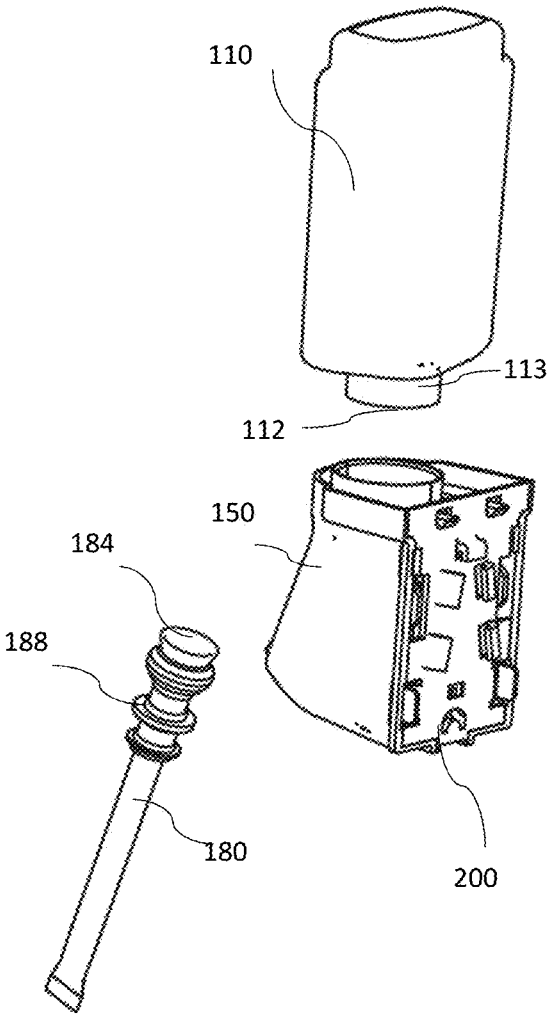
FIG. 5B is another perspective exploded view from a different viewing angle of the dispensing apparatus of FIG. 5A.

In the drawings, the reference numerals are listed below:

100 dispensing apparatus
110 replaceable container
112 container opening
113 container lower end
150 removable cover
155 cover opening
180 receptacle
184 receptacle opening
188 annular flange
200 dispensing control assembly
220 back frame
222 back frame stop feature
223 first pair of holes for valve actuator (back frame)
224 second pair of holes (back frame)
226 limiting slot (of lever)
226*a* front side of limiting slot
300 lever assembly
320 receptacle holder
322 stop lug
324 mount lugs
326 mount areas (for springs)
328 arcuate slot
330 lever
332 lever flanges
334 mount holes
338 stop feature (on lever flange)
339 connecting rod
340 control arms
342 control arm flange
344 lock pin
350 activation arm spring
360 main spring
400 funnel and valve assembly
410 funnel frame
412 funnel lower opening
414 funnel sidewall hole
416 valve holder
420 valve lever
422 valve lever arm
424 funnel lever pivotal rod
426 actuator pin
428 attachment portion
430 agitator
432 agitator axle
432*a* first end of agitator axle
432*b* second end of agitator axle
434 agitator arm
440 valve member
442 valve hole
444 valve opening
450 valve lever spring
460 gap
470 dispense point
500 material to be dispensed

DETAILED DESCRIPTION OF THE INVENTION

In the detailed description, numerous specific details are set forth in order to provide a thorough understanding of the invention. However, it will be understood by those skilled in the art that these are specific embodiments, and that the present disclosure may be practiced also in different ways that embody the characterizing features of the invention as described herein.

An embodiment of the present disclosure, shown in FIGS. 1A-10B, is a dispensing apparatus 100 for holding and dispensing a powdered or particulate material, such as sand or powdered candy. FIGS. 1A-1C show three views of the dispensing apparatus in an inactivated state. FIGS. 3A-3C show three views of the dispensing apparatus in an activated state. FIGS. 5A and 5B show two exploded views of the dispensing apparatus in the inactivated state. As shown in FIGS. 1A-1C, 3A-3C, 5A, and 5B, the dispensing apparatus includes a replaceable container 110 for holding the material to be dispensed, a receptacle 180 for receiving the material, a dispensing control assembly 200 connecting the replaceable container 110 and the receptacle 180, and a removable cover 150 for covering the dispensing control assembly 200. The removable container 110 has a container opening 112 in a lower end 113 through which the material being dispensed flows from the container 110. The receptacle 180 having an open upper end 184 for receiving the material being dispensed and an annular flange 188 for insertion into a slot to activate the dispensing control assembly 200. The removable cover 150 has an opening 155 for receiving the receptacle 180.

Figure 6A:
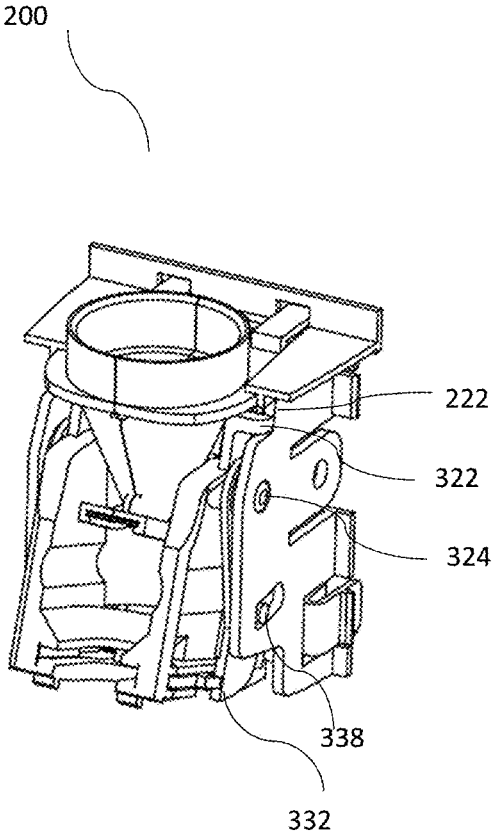
FIG. 6A is a partial perspective view of the dispensing apparatus of FIG. 1A focusing on the dispensing control assembly with front cover removed.
Figure 6B:
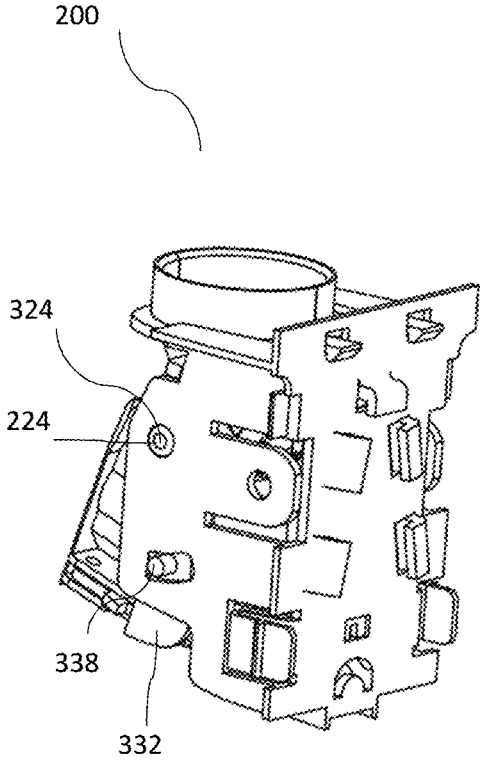
FIG. 6B is another partial perspective view the dispensing apparatus of FIG. 1A from a different viewing angle, focusing on the dispensing control assembly with front cover removed.
Figure 7A:
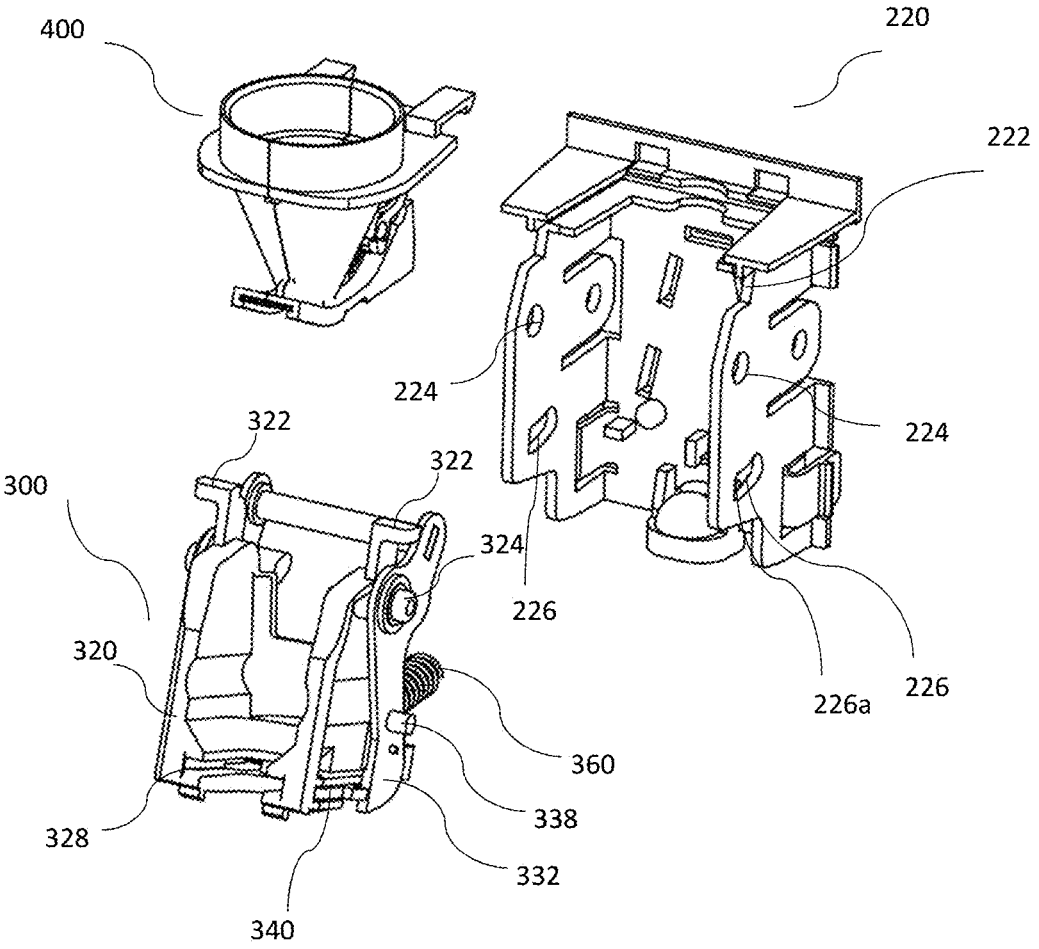
FIG. 7A is a perspective exploded view of the components of the dispensing control assembly of FIG. 6A.

FIGS. 6A and 6B show two perspective views of the dispensing control assembly 200. FIGS. 7A and 8B show the components of the dispensing control assembly 200 in two perspective exploded views. As shown in FIGS. 6A-7B, the dispensing control assembly 200 comprises a back frame 220, a funnel and valve assembly 400, and a lever assembly 300.

Figure 7B:
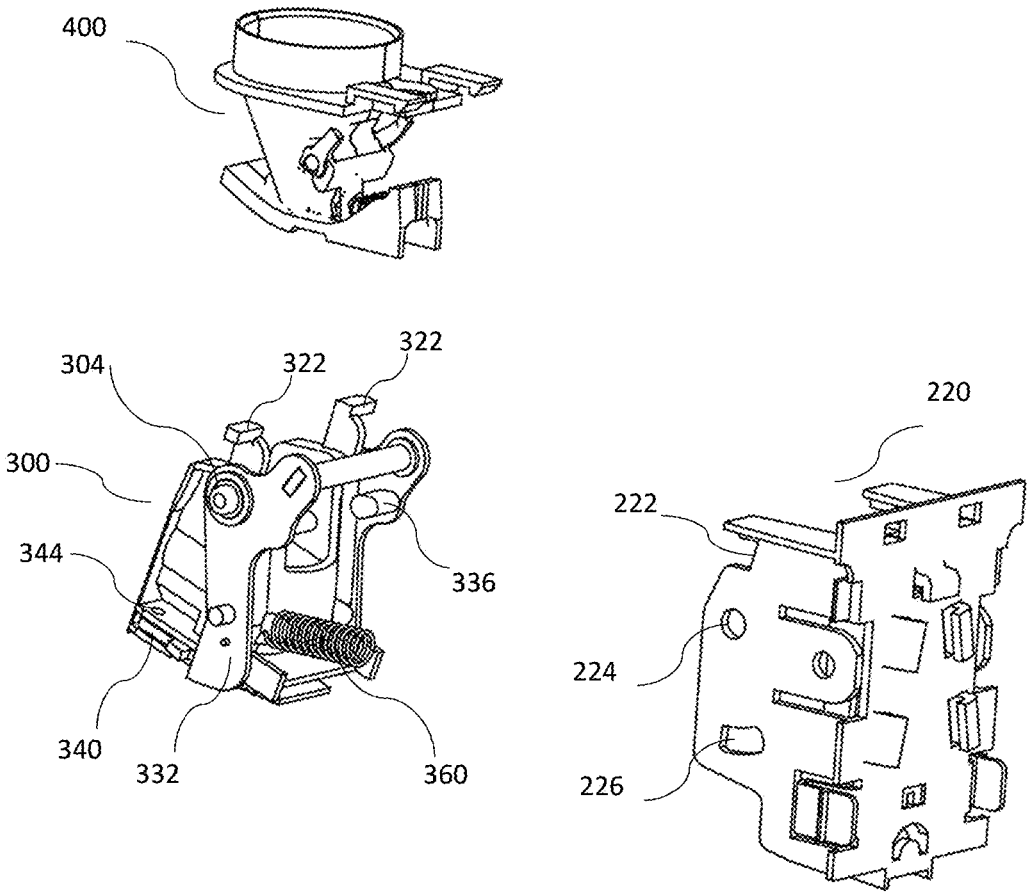
FIG. 7B is a perspective exploded view of the components of the dispensing control assembly of FIG. 6B.

As shown in FIGS. 7A and 7B, the back frame 220 comprises a pair of holes 224 (one on each side), a pair of back frame stop features 222, and a pair of limiting slots 226 (one on each side). Each limiting slot has a front side 226*a*.

Figure 8A:
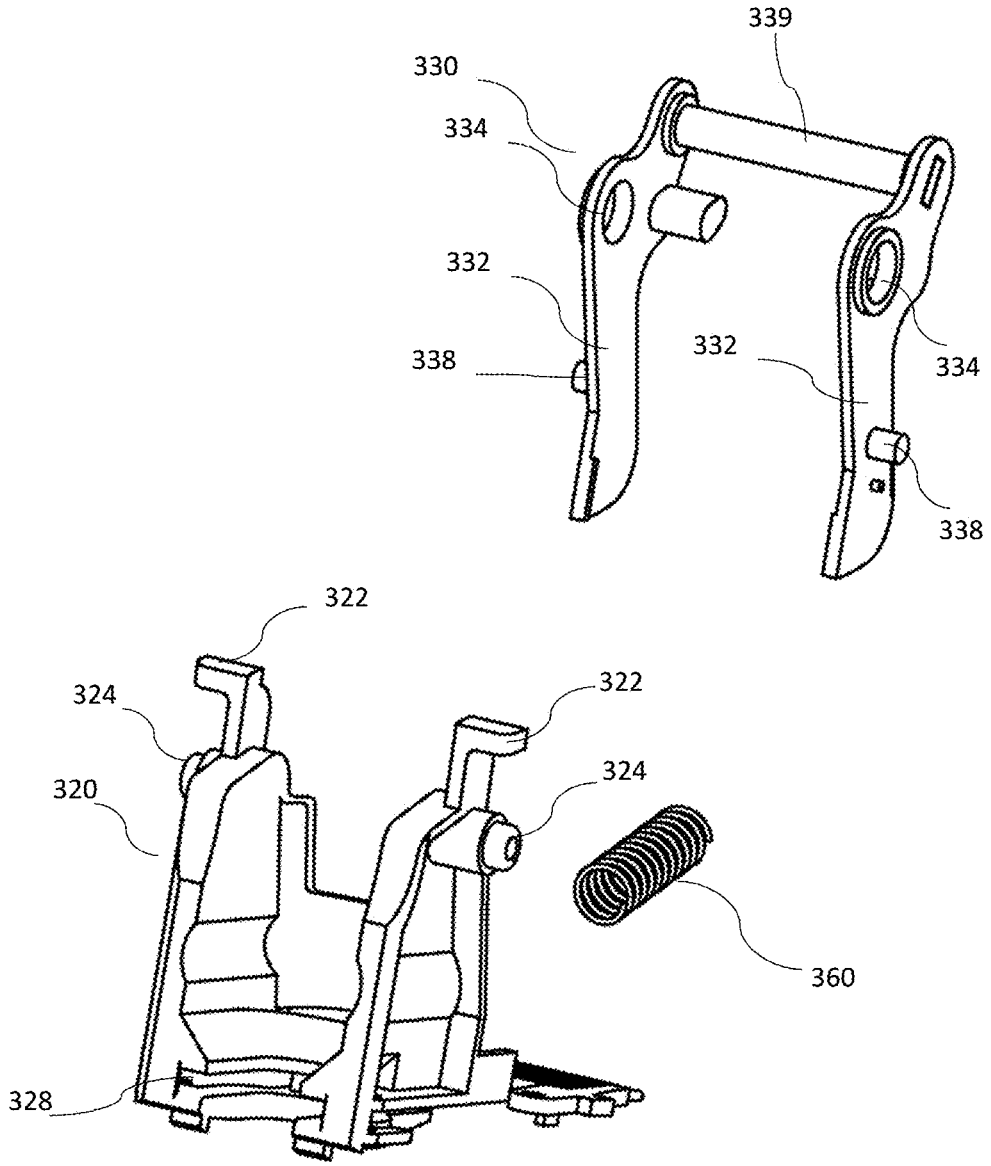
FIG. 8A is a perspective exploded view of the components of the lever assembly in FIG. 7A.
Figure 8B:
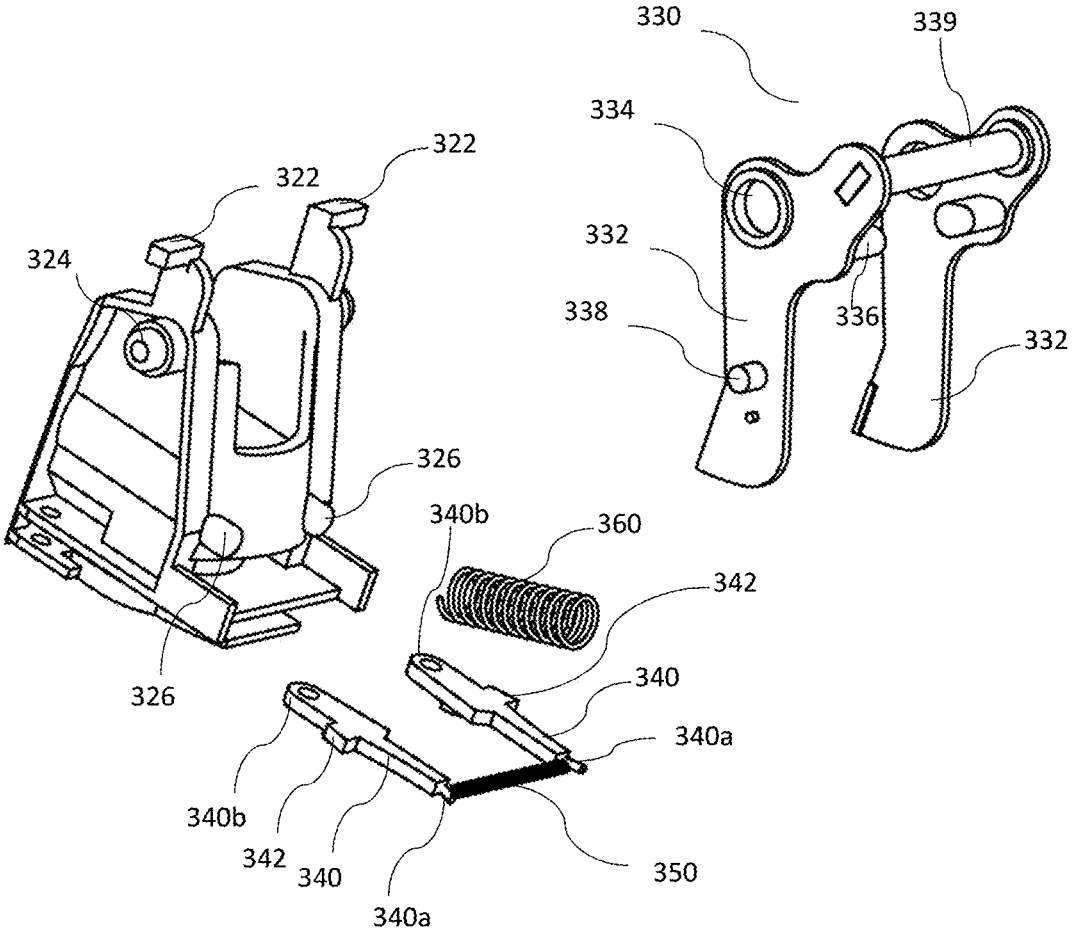
FIG. 8B is a perspective exploded view of the components of the lever assembly in FIG. 7B.

The lever assembly 300 is illustrated in the exploded views in FIGS. 8A and 8B. Referencing FIGS. 8A and 8B, the lever assembly 300 comprises a receptacle holder 320, a main spring 360, a lever 330 formed by a pair of lever flanges 332 connected by a connecting rod 339, and a pair of control arms 340 linked by a linking spring 350. The receptacle holder 320 comprises a pair of stop lugs 322 (one on each side), a pair of pivotal mount lugs 324 (one on each side) with outside diameters slightly smaller than holes 224 of back frame 220, a pair of spring mount areas 326 (shown in FIG. 8B), and arcuate slot 328 (shown in FIGS. 7A and 8A) for accepting the annular flange 188 of the receptacle 180 (annular flange shown in FIG. 5A and FIG. 5B). Each lever flange comprises a mount hole 334, and a stop protrusion 338 on its outside surface. The lever 330 is axially connected to the receptacle holder 320 with the mount lugs 324 of the receptacle holder loosely penetrating through mount holes 334.

Referencing FIGS. 8A and 8B, the control arms 340 each has a control arm flange 342, a first end 340*a*, and a second end 340*b*. The first ends 340*a* of the control arms 340 are biased toward each other by the linking spring 350. As shown in FIGS. 7A and 7B, the second ends 340*b* of the control arms 340 may be pivotally attached within the arcuate slot 328 with a lock pin 344.

Referencing FIGS. 6A and 6B, the receptacle holder 320 is axially connected to the back frame 220 with the pair of lugs 324 (one on each side) penetrating the second pair of holes 224 (also shown in FIG. 7A and FIG. 7B) of the back frame 220. Referencing FIGS. 2A and 6A, in the inactivated state, the receptacle holder 320 is rotationally biased clockwise (as viewed from right side) by the main spring 360 (shown in FIG. 2A, a section view of the dispensing apparatus in the inactive state as viewed from the right side) until the lugs 322 contact the stop feature 222 of back frame 220 and the stop protrusion 338 contact the front side 226*a* of the limiting slot 226 of the back frame 220 (shown in FIG. 6A).

Figure 10A:
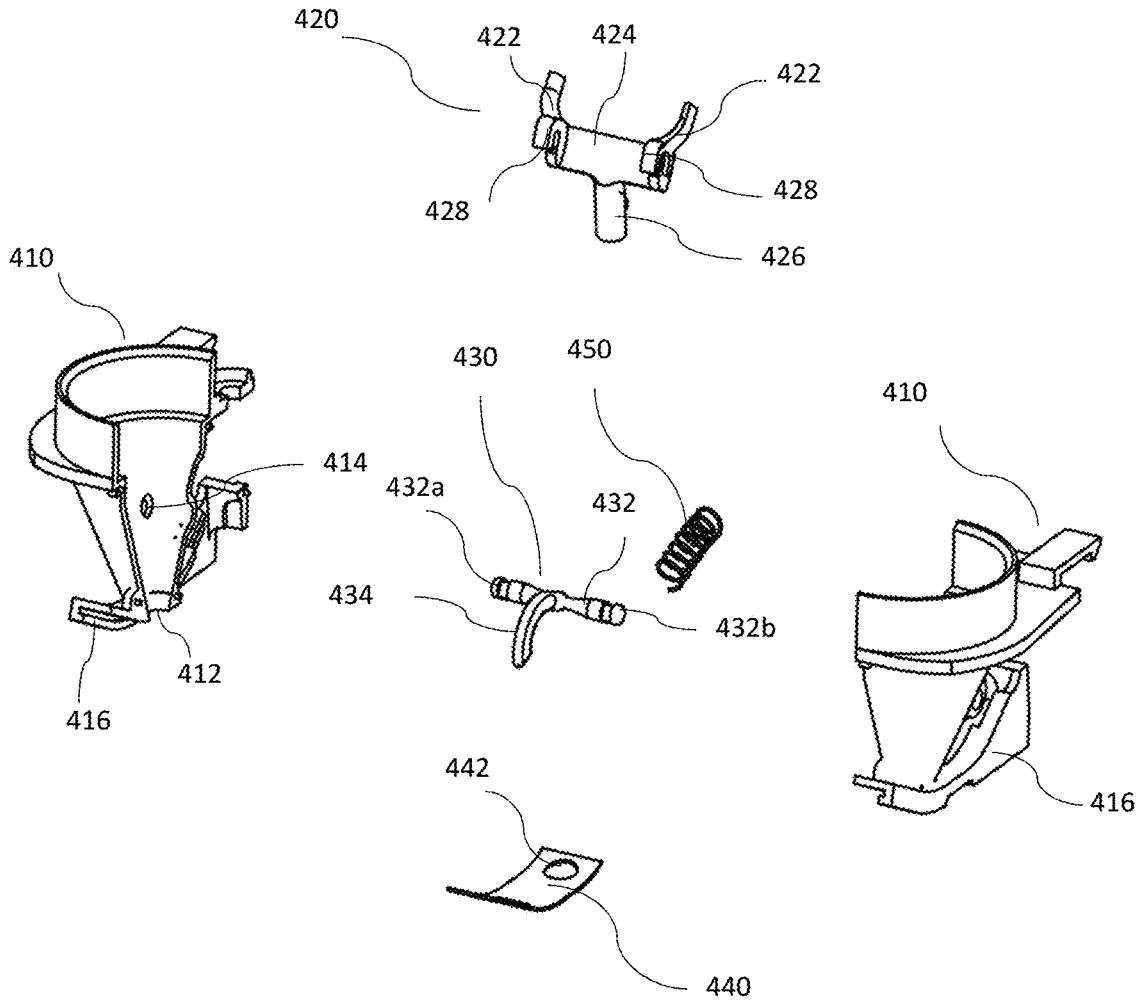
FIG. 10A is another exploded view of the funnel and valve assembly in the inactivated operation mode.
Figure 10B:
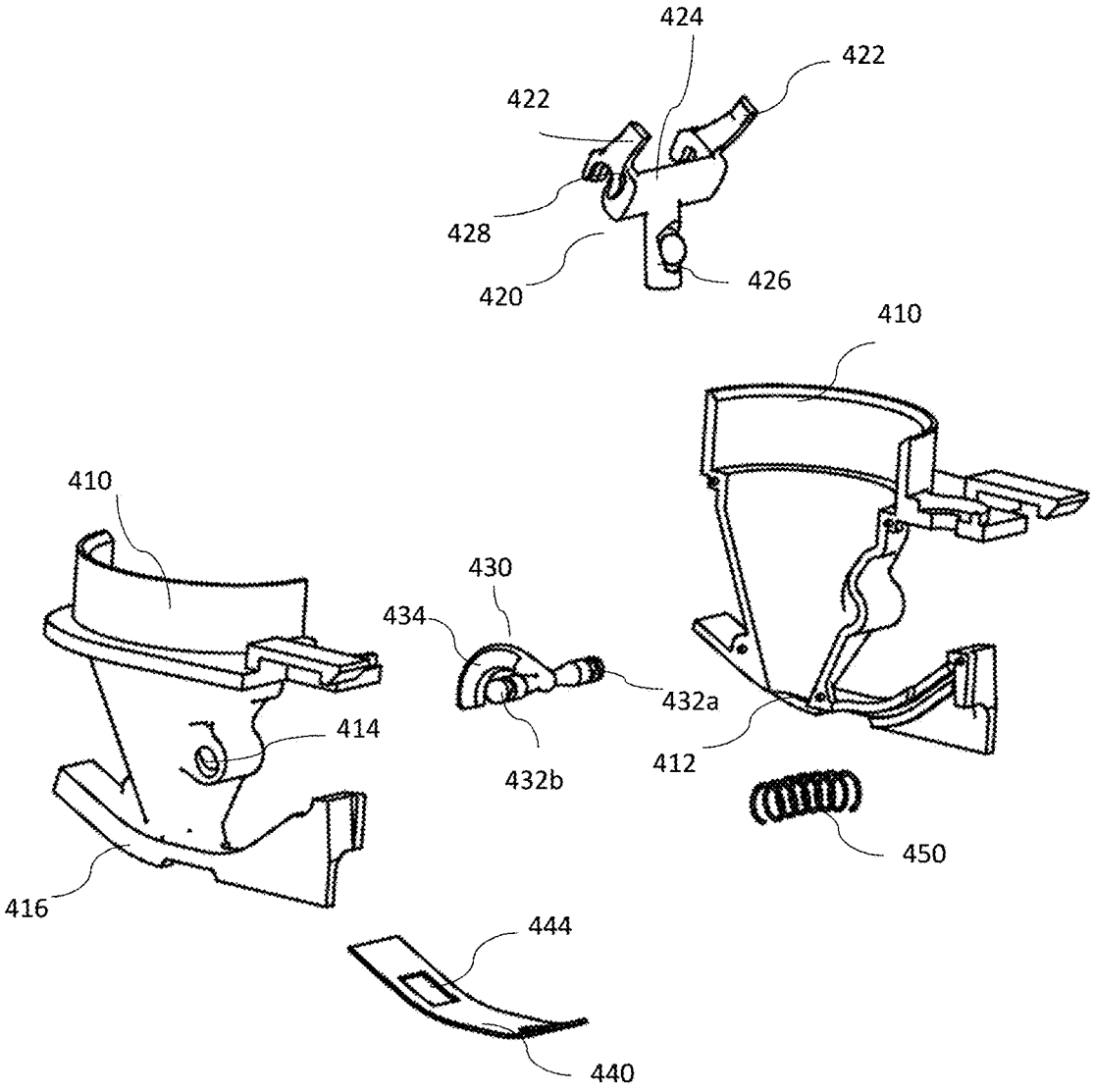
FIG. 10B is another exploded view of the funnel and valve assembly in the inactivated operation mode.

Referencing FIGS. 10A and 10B, the funnel and valve assembly 400 comprises a funnel frame 410 (shown as a separated left half and a right half in FIGS. 10A and 10B for visualization), a valve lever 420, an agitator 430, a valve member 440, and a valve lever spring 450. The funnel frame has a funnel lower opening 412 and a valve holder 416 at a bottom side of the funnel frame and a pair of sidewall holes 414 on the two side of the sidewall of the funnel frame. The valve lever 420 has a lever pivotal rod 424, a pair of lever arms 422 extending from the two ends of the lever pivotal rod 424, a pair of attachment portions 428 at the two ends of the lever pivotal rod 424, and actuator pin 426 extending from a middle point of the lever pivotal rod 424. The agitator 430 includes an agitator axle 432 having a first end 432*a* and a second end 432*b*, and an agitator arm 434 extending from a middle point of the agitator axle 432. The valve member 440 is a flat piece having a valve hole 442 (shown in FIG. 10A) and a valve opening 444 (shown in FIG. 10B).

Figure 9A:
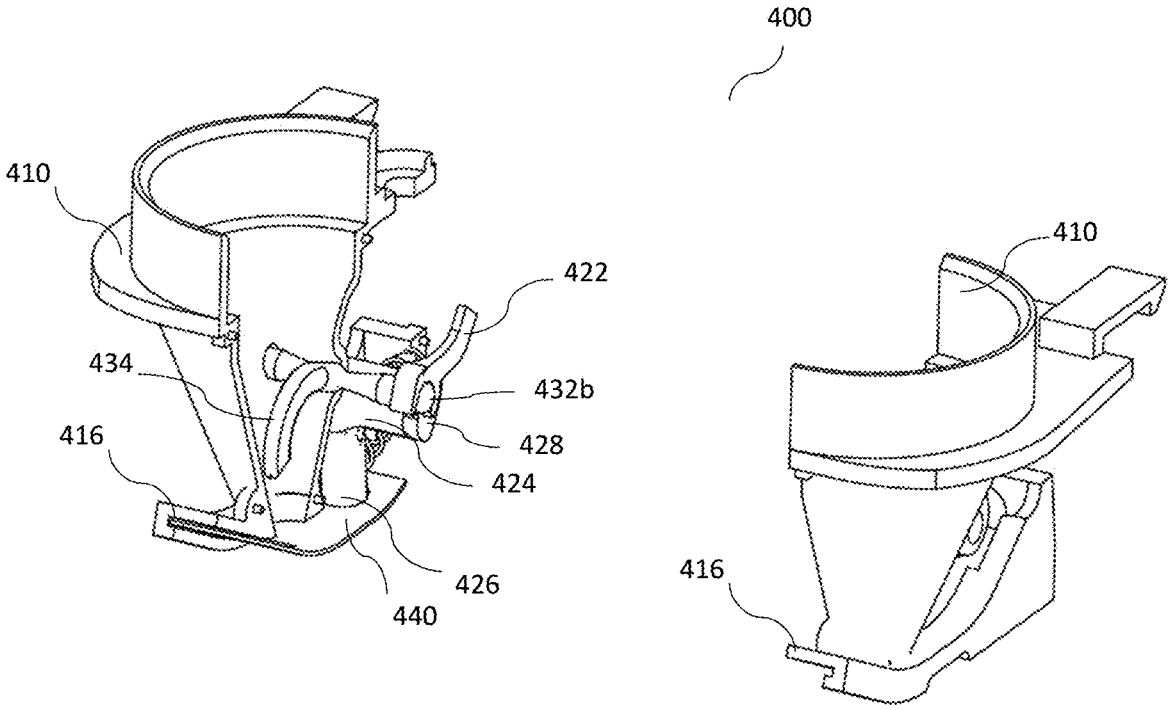
FIG. 9A is perspective view of the funnel and valve assembly in the inactivated operation mode, where a right half of the funnel frame is removed to show the arrangement of internal components.
Figure 9B:
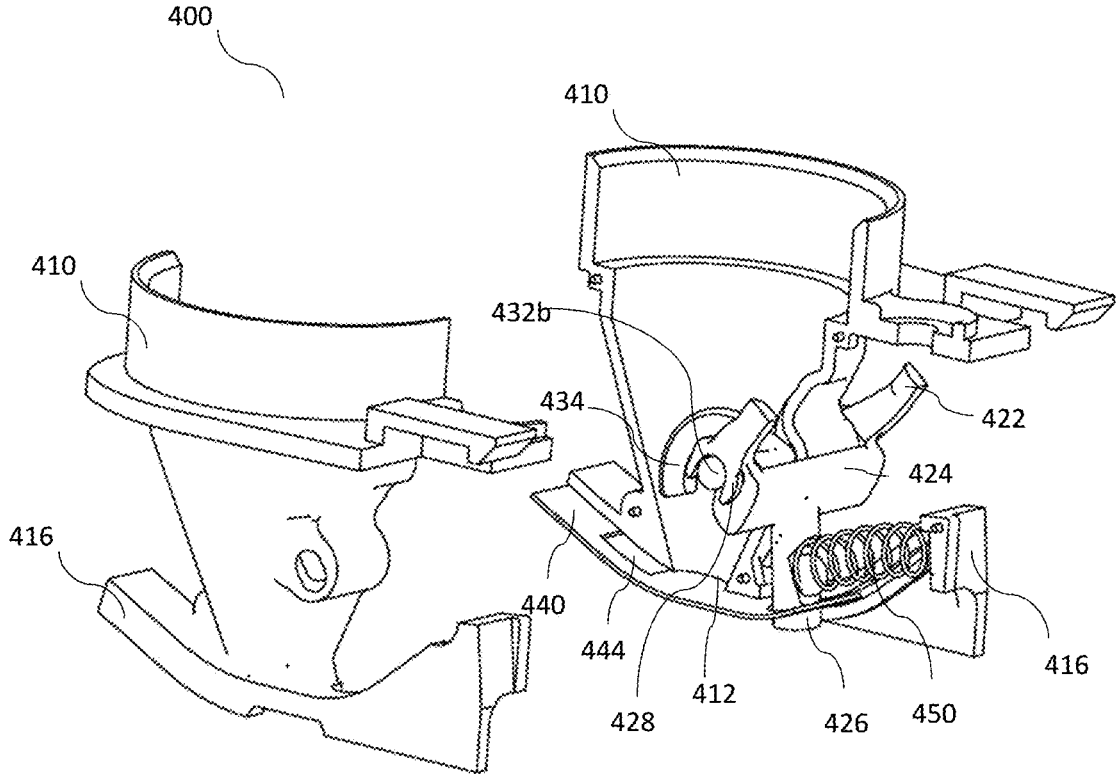
FIG. 9B is another perspective view of the funnel and valve assembly in the inactivated operation mode, where a right half of the funnel frame is removed to show the arrangement of internal components.

Referencing FIGS. 9A and 9B, each of the two ends of the agitator axle 432 penetrates one of the two sidewall holes 414 of the funnel frame 410 to rotatably fix the agitator axle 432 to the lever frame 410. Each attachment portion 428 of the lever pivotal rod 424 is fixedly attached to one of the two ends 432*a* and 432*b* of the agitator axle 432. The actuator pin 426 of valve lever 420 is fixedly attached to the valve member 440 by penetrating the valve hole 442. The valve member 440 is slidably held in the valve holder 416 of the funnel frame. The valve lever spring 450 connects to the actuator pin 426 of the valve lever 420 at a first end of the spring, and to a back end of the valve holder 416 of the funnel frame 410 at a second end of the spring. As shown in FIG. 9B, in the inactivated operation mode, the valve lever spring 450 biases the actuator pin 426 toward the front side of the dispensing apparatus. Since the actuator pin 426 is fixed to the valve member 440, in the inactivated state, the valve member 440 is pushed forward by the valve lever spring 450 through the actuator pin 426. In this configuration, the valve opening 444 does not align with the funnel lower opening 412, thus preventing any material being dispensed.

Figure 11A:
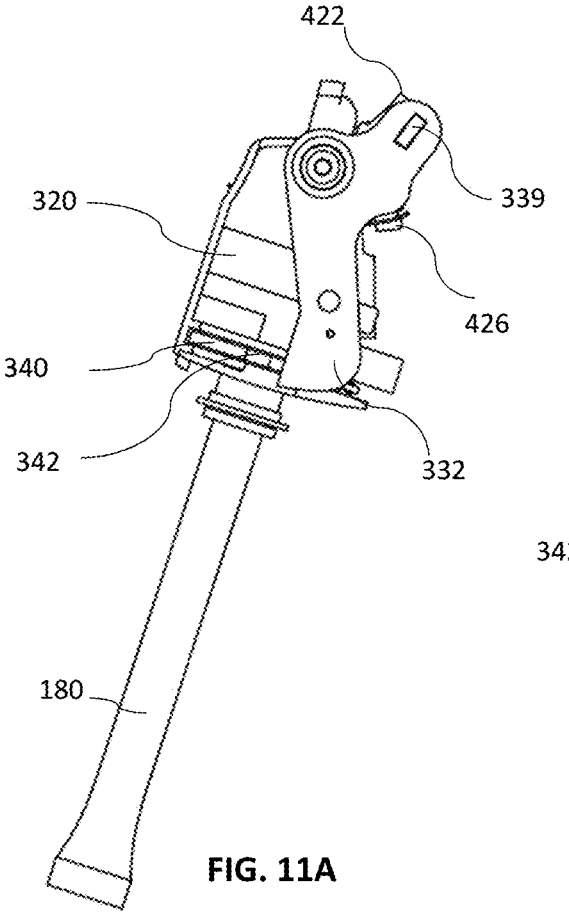
FIG. 11A is a right side view illustrating a positional configuration of several components when the dispending apparatus is in the inactivated operation mode.
Figure 11B:
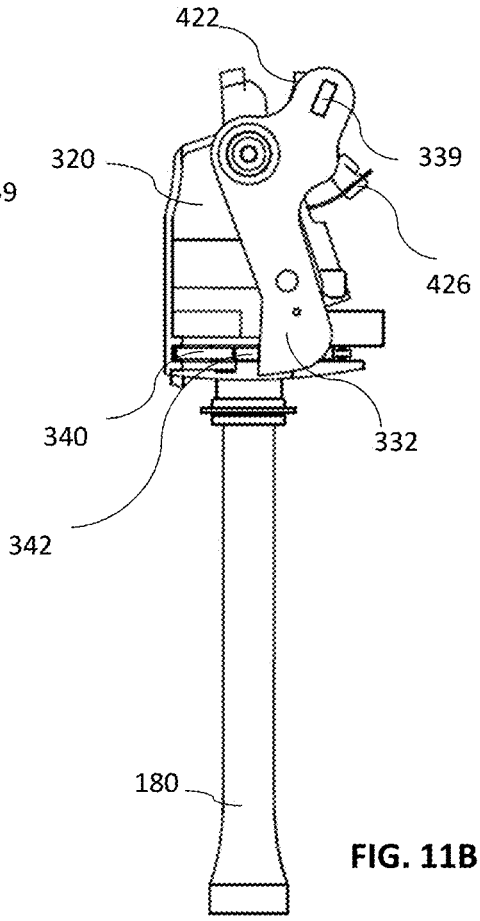
FIG. 11B is a right side view illustrating another positional configuration of several components when the dispending apparatus is in the activated operation mode.

The operation of the dispensing apparatus is described in the following with be reference to FIGS. 1A-10B, and further reference to FIG. 11A (showing a positional configuration of the receptacle 180, the receptacle holder 320, the control arms 340, the lever 330, and the valve lever 420 when the dispenser is in the inactivated operation mode) and FIG. 11B (showing a positional configuration of the receptacle 180, the receptacle holder 320, the control arms 340, the lever 330, and the valve lever 420 when the dispenser is in the activated operation mode). To activate the dispensing apparatus, an operator may insert the flange 188 of the receptacle 180 through the opening 155 of the front cover 150, and into slot 328 of the receptacle holder 320. This forces the control arms 340 pivot outward, overcoming the force of the activation arm spring 350. With the control arms pivoted outward, control arm flanges 342 extend beyond slot 328 and engages lever flanges 332 of lever 330. When the user continues to push the receptacle 180 further inward from the position in FIG. 11A to the position in FIG. 11B, the control arm flanges 342 engage with the lever flanges 332 and pushes the lever flanges 332 in the counter-clockwise direction. As a result, the connecting rod 339 of the lever 330 pushes the two valve lever arms 442 of the valve lever 440 in the counter-clockwise direction and compress the valve lever spring 450 (e. g., see FIG. 4A). Thus, the actuator pin 426 of the valve lever 440 also rotates counter-clockwise and draws the valve member 440 backward, aligning the valve opening 444 with the funnel lower opening 412, allowing material to be dispensed. When the pressure on the receptacle 180 that pushes it inward is withdrawn, the receptacle holder 320 is again rotationally biased clockwise (as viewed from right side) by the main spring 360, the actuator pin 426 is biased by the valve lever spring 450 toward the front side of the dispensing apparatus, and the dispensing of the material is shut off.

Further, if the operator uses an object other than the receptacle 180 (i.e. finger) to press the receptacle holder 320 inward, the control arms 340 do not pivot outward, therefore the control arm flanges 342 do not engage with lever flanges 332 of the lever 330. In this case, the lever flanges 332, the valve lever arms 442, or actuator pin 426 are not rotated in the counter-clockwise direction, and the valve member 440 is still biased forward and blocks the flow of any material from funnel frame 410. Therefore, the dispensing apparatus will not be accidentally activated by an object other than the receptacle 180.

Figure 12:
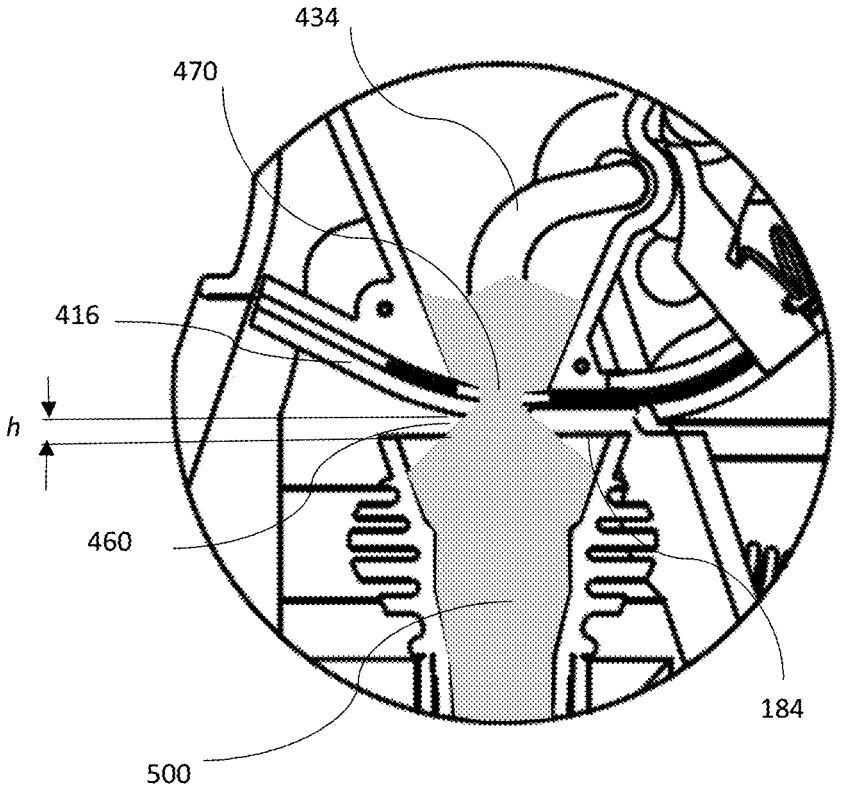
FIG. 12 is a detailed section view showing the valve mechanism of the funnel and valve assembly in the activated operation mode.

FIG. 12 shows the valve mechanism of the funnel and valve assembly in the activated operation mode. Referencing FIG. 12, a gap 460 is configured between the bottom surface of the valve holder 416 and the top of the receptacle 180. The gap 460 prevents the funnel frame 410 from being contaminated by contacting the receptacle 180. Further, a width h of the gap 460 may be chosen so that a natural cohesion of a granular powder to-be-dispensed material 500 creates an automatic flow stop. As shown in FIG. 12, the to-be-dispensed material 500 may form a truncated cone shape between the receptacle opening 184 and a dispense point 470 when the receptacle is filled. When a combination of the gap width h, a first aperture size at the dispense point 470, a second aperture size at the receptacle opening 184, and the granular properties of the to-be-dispensed material 500 is within a certain range, the truncated cone of the to-be-dispensed material 500 will prevent further flow of the to-be-dispensed material 500 from the funnel frame, thus stopping the dispensing process to prevent overspill. Of course, the dispensing process can also be stopped by withdrawing the pressure on the receptacle 180 that pushes it inward. Therefore, the receptacle 180 can be partially filled according to user manual control. When the properties of the to-be-dispensed material 500 and the dimensions of the receptacle opening 184 are fixed, the gap width h may be selected to both allow material dispensing when there is space in the receptacle and prevent material dispensing when the receptacle is filled to the receptacle opening. In certain embodiments, the gap width h may be chosen to be equal or smaller than a diameter of the receptacle opening 184.

The foregoing description and accompanying drawings illustrate the principles, preferred or example embodiments, and modes of assembly and operation, of the invention; however, the invention is not, and shall not be construed as being exclusive or limited to the specific or particular embodiments set forth hereinabove.

What is claimed is:

1. A dispensing apparatus for dispensing a material, comprising:

a removable container for holding the material;

a receptacle for receiving the material, the receptacle comprising a top opening and a flange;

a funnel for receiving the material from the removable container and guiding the material to the receptacle, the funnel comprising a valve holder at a lower end of the funnel and a lower opening aligned with the top opening of the receptacle;

a valve member slidably coupled to the valve holder, the valve member comprising a valve aperture;

a valve lever connected to the valve member, wherein when activated, the valve lever is configured to move the valve member to cause the valve aperture to align with the lower opening of the funnel, allowing the material to flow down from the funnel to the receptacle until the receptacle is filled to the top opening;

a lever assembly coupled to the valve lever, wherein the lever assembly is configured to be activated by an operator inserting the flange of the receptacle into the lever assembly, and when activated, the lever assembly is configured to activate the valve lever; and a gap separating the valve member and the top opening of the receptacle, the gap having a gap width greater than zero and less than a predetermined value, wherein the gap width is chosen according to a first aperture size of a dispending point at the valve aperture, a second aperture size of the top opening of the receptacle, and granular properties of the material to be dispensed such that when the valve lever is activated and the material flows down and fills the receptacle to the top opening, the material further fills the gap, causing the material to stop flowing down.

2. The dispensing apparatus according to claim 1, further comprising a back frame, the back frame having a pair of holes and a pair of stop features.

3. The dispensing apparatus according to claim 2, wherein the lever assembly comprises:

a receptacle holder, the receptacle holder including a pair of actuating slots to receive the flange of the receptacle, a pair of mount lugs pivotally mount the receptacle holder to the back frame through the pair of holes of the back frame, and a pair of stop lugs protruding from the receptacle holder; and a main frame spring having a first end connected to the receptacle holder and a second end connected to the back frame, the springs tilting the receptacle holder away from the back frame until the stop lugs of the receptacle holder contact the stop features of the back frame.

4. The dispensing apparatus according to claim 3, wherein the lever assembly further comprises a pair of lever flanges, each lever flange comprising a flat lever flange member, and a mount hole in the flat lever flange member allowing one of the mount lugs of the receptacle holder loosely fitting into the mount hole.

5. The dispensing apparatus according to claim 4, wherein the back frame further comprises a pair of limiting slots, and each lever flange further comprises a stop member protruding from the flat flange member, wherein the stop members fit through the limiting slots and the limit slots limit a pivoting range of the lever flanges.

6. The dispensing apparatus according to claim 4, wherein the lever assembly further comprises:

a pair of control arms, each control arm having a first end, a second end, and a control arm flange between the first end and the second end; and a linking spring connecting the first ends of the pair of control arms;

wherein the second ends of the control arms are pivotally attached within the actuating slots of the receptacle holder; and when the receptacle is pushed into the receptacle holder with the flange of the receptacle received into the actuating slots of the receptacle holder, the pair of the control arms are pivoted outward, and the flanges of the control arms extend beyond the actuating slots and engage the lever flanges.

7. The dispensing apparatus according to claim 4, wherein the lever assembly further comprises a connecting rod connecting the pair of lever flanges.

8. The dispensing apparatus according to claim 7, wherein the valve lever comprises:

a lever pivotal rod, a pair of lever arms extending from the lever pivotal rod, an actuator pin extending from a middle point of the lever pivotal rod, the actuator pin being fixedly attached to the valve member, and a valve lever spring connecting the actuator pin and a back end of the valve holder.

9. The dispensing apparatus according to claim 1, further comprising an agitator, the agitator including an agitator axle and an agitator arm extending from a middle point of the agitator axle.

10. The dispensing apparatus according to claim 1, further comprising a removable cover to limit ambient powder material during dispensing.

11. The dispensing apparatus according to claim 1, wherein the gap width is equal to or below a diameter of the top opening of the receptacle.

12. A dispensing apparatus for dispensing a material, comprising:

a removable container for holding the material;

a receptacle for receiving the material, the receptacle comprising a top opening and a flange;

a funnel for receiving the material from the removable container and guiding the material to the receptacle, the funnel comprising a valve holder at a lower end of the funnel and a lower opening aligned with the top opening of the receptacle;

a valve member slidably coupled to the valve holder, the valve member comprising a valve aperture;

a valve lever connected to the valve member, wherein when activated, the valve lever is configured to move the valve member to cause the valve aperture to align with the lower opening of the funnel, allowing the material to flow down from the funnel to the receptacle until the receptacle is filled to the top opening;

a lever assembly coupled to the valve lever, wherein the lever assembly is configured to be activated by an operator inserting the flange of the receptacle into the lever assembly, and when activated, the lever assembly is configured to activate the valve lever;

a gap separating the valve member and the top opening of the receptacle, the gap having a gap width greater than zero and less than a predetermine value, wherein when the valve lever is activated and the material flows down and fills the receptacle to the top opening, the material further fills the gap, causing the material to stop flowing down; and a back frame, the back frame having a pair of holes and a pair of stop features;

wherein the lever assembly includes:

a receptacle holder, the receptacle holder including a pair of actuating slots to receive the flange of the receptacle, a pair of mount lugs pivotally mount the receptacle holder to the back frame through the pair of holes of the back frame, and a pair of stop lugs protruding from the receptacle holder; and a main frame spring having a first end connected to the receptacle holder and a second end connected to the back frame, the springs tilting the receptacle holder away from the back frame until the stop lugs of the receptacle holder contact the stop features of the back frame.

13. The dispensing apparatus according to claim 12, wherein the lever assembly further comprises a pair of lever flanges, each lever flange comprising a flat lever flange member, and a mount hole in the flat lever flange member allowing one of the mount lugs of the receptacle holder loosely fitting into the mount hole.

14. The dispensing apparatus according to claim 13, wherein the back frame further comprises a pair of limiting slots, and each lever flange further comprises a stop member protruding from the flat flange member, wherein the stop members fit through the limiting slots and the limit slots limit a pivoting range of the lever flanges.

15. The dispensing apparatus according to claim 13, wherein the lever assembly further comprises:

a pair of control arms, each control arm having a first end, a second end, and a control arm flange between the first end and the second end; and a linking spring connecting the first ends of the pair of control arms;

wherein the second ends of the control arms are pivotally attached within the actuating slots of the receptacle holder; and when the receptacle is pushed into the receptacle holder with the flange of the receptacle received into the actuating slots of the receptacle holder, the pair of the control arms are pivoted outward, and the flanges of the control arms extend beyond the actuating slots and engage the lever flanges.

16. The dispensing apparatus according to claim 13, wherein the lever assembly further comprises a connecting rod connecting the pair of lever flanges.

17. The dispensing apparatus according to claim 16, wherein the valve lever comprises:

a lever pivotal rod, a pair of lever arms extending from the lever pivotal rod, an actuator pin extending from a middle point of the lever pivotal rod, the actuator pin being fixedly attached to the valve member, and a valve lever spring connecting the actuator pin and a back end of the valve holder.

18. The dispensing apparatus according to claim 12, further comprising an agitator, the agitator including an agitator axle and an agitator arm extending from a middle point of the agitator axle.

19. The dispensing apparatus according to claim 12, further comprising a removable cover to limit ambient powder material during dispensing.

* * * * *